United States Patent [19]

Mann

[11] Patent Number: 4,944,267

[45] Date of Patent: Jul. 31, 1990

[54] ELECTROPNEUMATIC DISPLACEMENT DEVICE FOR A THROTTLE VALVE OF AN INTERNAL COMBUSTION ENGINE

[75] Inventor: Arnold Mann, Bieber, Fed. Rep. of Germany

[73] Assignee: VDO Adolf Schindling AG, Frankfurt am Main, Fed. Rep. of Germany

[21] Appl. No.: 411,306

[22] Filed: Sep. 22, 1989

[30] Foreign Application Priority Data

Dec. 1, 1988 [DE] Fed. Rep. of Germany ..... 3840465

[51] Int. Cl.[5] ..... F02D 9/02; F02M 3/07; F15B 15/10

[52] U.S. Cl. ..... 123/339; 123/360; 123/399; 123/401

[58] Field of Search ..... 123/339, 340, 360, 361, 123/399, 401

[56] References Cited

U.S. PATENT DOCUMENTS

| | | | |
|---|---|---|---|
| 4,479,472 | 10/1984 | Shimamura | 123/401 X |
| 4,660,518 | 4/1987 | Tamaki | 123/401 X |
| 4,735,179 | 4/1988 | Ejiri et al. | 123/401 X |
| 4,736,720 | 4/1988 | Asakura et al. | 123/339 |
| 4,829,960 | 5/1989 | Yuzawa et al. | 123/339 |

FOREIGN PATENT DOCUMENTS

| | | | |
|---|---|---|---|
| 0070031 | 4/1983 | Japan | 123/401 |
| 0152136 | 9/1983 | Japan | 123/401 |

*Primary Examiner*—Willis R. Wolfe
*Attorney, Agent, or Firm*—Martin A. Farber

[57] ABSTRACT

A displacement device for a throttle valve of an internal combustion engine in idling condition, has a housing, a diaphragm which is arranged in a chamber in the housing and is operatively connected to the throttle valve, a spring in the chamber, which spring acts with one end against the diaphragm, a vacuum connection to the one chamber, a connection for atmospheric pressure, a coil, and an armature which is axially displaceable in the coil, a valve body being firmly connected to the armature and keeping a connection for atmospheric pressure open or closed corresponding to its instantaneous position. A single connection for atmospheric pressure leads to the chamber and is kept open or closed by the valve body. The connection for vacuum is also kept open or closed by the valve body, the two connections being opened alternately. The valve body is acted on by the spring. The coil current is provided as control variable for the position of the throttle valve.

10 Claims, 3 Drawing Sheets

ELECTROPNEUMATIC DISPLACEMENT DEVICE FOR A THROTTLE VALVE OF AN INTERNAL COMBUSTION ENGINE

FIELD AND BACKGROUND OF THE INVENTION

The present invention relates to an electropneumatic displacement device for a throttle valve of an internal combustion engine in idling condition. The device has a housing and a diaphragm arranged in a chamber in the housing, the diaphragm forming an outer wall of the chamber and of the housing and being operatively connected to the throttle valve. A spring in the chamber acts with one end against the diaphragm. The device also has a connection for atmospheric pressure, a magnet coil and an armature which is axially displaceable in the magnet coil and to which a valve body is firmly attached. The valve body has a connection for atmospheric pressure which is open or closed, corresponding to valve position at the time.

Such a displacement device has been described in Federal Republic of Germany AS 28 30 738. The diaphragm is arranged between two diaphragm plates against which a compression spring rests. Corresponding to the difference in pressure between the two chambers, the diaphragm arches toward the vacuum side, whereby a correcting element which acts on the throttle valve is correspondingly displaced. Due to the initial tension of the spring, a displacement of the diaphragm or of the correcting element by the connection of a load is prevented. In order to compensate also for changes due to the connection of a further load, a solenoid valve is provided which is actuated by the connection. Depending on the switch position of the solenoid valve, a connection for atmospheric pressure is opened or closed, as a result of which a vacuum in the one chamber can be rapidly eliminated.

In this known displacement device, however, no measure has been taken against the contingency that under certain circumstances the throttle valve may move only with difficulty whereby the setting force required for the actuation of the correcting member becomes larger. In this case, a larger setting current must be fed to the displacement device in order not only to overcome the resistance to the displacement but also, to effect a displacement. Without additional measures it may happen, due to the frictional hysteresis, that the throttle valve is not displaced at all. A displacement actuation of the displacement device which then takes place without any actual effect leads to so-called sawing, i.e. the setting signal given off by the controller has no effect on the correcting member and the control circuit regulates continuously around the desired value.

SUMMARY OF THE INVENTION

It is an object of the invention to develop an electropneumatic displacement device of the type described in such a manner that a setting signal results in a corresponding displacement, i.e. a setting current leads to the desired change in the amount of air fed to the internal combustion engine.

According to the invention, the connections (24, 28) for vacuum and atmospheric pressure are alternately kept open by the valve body (126), the valve body (126) is acted on by the other end of the spring (44), and the coil current is a control variable for the position of the throttle valve.

This development results in a hysteresis-free current-path behavior of the correcting member, independently of load and friction. Advantageous further developments of the displacement device of the invention are disclosed hereinafter.

The construction of the displacement device of the invention makes it possible always to set a position of rest corresponding to the operating conditions at the time in which the setting signal or current signal just compensates for the spring force. This is accomplished without a movement of displacement occurring and on basis of which every change in the setting signal results in an actuation of the correcting member, independently of frictional or other phenomena and pressure conditions. The displacement device is therefore extremely precise and the positioning precision great.

The connection (28) for vacuum is advisedly connected to the intake port (2) downstream of the throttle valve (4) and the connection (24) for atmospheric pressure, to the intake port (2) upstream of the throttle valve (4). The feed lines are in this way very short and no energy is lost. With this construction of the displacement device, the air required for the control is, in advantageous manner, taken directly from that intake section where the amount of air for the injection into the cylinders of the internal combustion engine is measured and a sufficient vacuum is always present. Thus, due to the control by means of the displacement device, no secondary air can be fed to the injection system. It is furthermore advantageously avoided that the air/fuel mixture becomes too lean by the drawing in of unmeasured air. These measures are made possible, in particular, by the fact that the throttle valve is always almost closed upon the idling of the internal combustion engine and a sufficient vacuum builds up behind the throttle valve.

The throttle valve (4) advantageously comprises a smaller control valve (8) which is actuated by the displacement device and is developed in symmetrical fashion. The smaller control valve serves only for control purpose and not for adjustments of the throttle valve corresponding to different driving conditions, so that it is merely acted on by pressure and can be easily displaced due to its small mass and dimensions. As a result, the dimensions and design of the displacement device can be reduced, due to which it can thus easily be installed in the throttle-valve region.

A particularly simple construction of the displacement device in accordance with the invention results when the diaphragm (42) is a roller diaphragm and is acted on by the spring (44).

Hysteresis-free operation of the displacement device of the invention is advantageously obtained in the manner that it has an air-chamber damping device. The displacement body then experiences in its position facing away from the diaphragm no oscillations at all or only minimal ones.

In one preferred embodiment of the displacement device of the invention the valve body (120) is developed as a slide, in particular a piston slide. Annular grooves (158, 160) are provided in the connection region in a wall section which surrounds the slide and contains the connections (24, 28) for vacuum and atmospheric pressure which are arranged axially spaced from each other. A uniform change in pressure corresponding to the pressure connection which is active at the time is made possible by this development of the grooves; and no lateral forces and friction resulting therefrom are produced on the piston slide. The distance between the valve body and the wall section surrounding it is, in this connection, such that a small leakage is present. This leakage is not disturbing and rather prevents hysteresis of the displacement movement of the valve body.

A particularly simple construction and favorable operating properties of the displacement device of the invention result if the valve body (120) has a first cylindrical control section (126) of a diameter which is somewhat smaller than the inside diameter of the wall section surrounding the slide or valve body (120) and if it has, adjacent to the first control section, a second or third control section (124 and 128) of smaller diameter. The positioning of the first control section with respect to a connection determines its closed condition, and the positioning of the second or third control section with respect to a connection determines its open condition. The axial dimensioning of the first control section permits it to be positioned simultaneously with respect to both connections.

By arranging the connection (24) for atmospheric pressure closer to the one chamber (50) than the connection (28) for vacuum, disadvantageous disturbances due to variations of pressure in the vacuum section of the intake pipe can be prevented reliably.

In one preferred embodiment of the invention, the spring is supported on a plate-shaped part with which the valve body is in engagement. In this way, there results a particularly simple construction of the displacement device with a centering action of the spring, without a building up of lateral forces which act on the valve body.

As alternative, the spring (44) is supported, for instance, preferably on a swingable part (86) the axis of swing (88) of which is axially staggered with respect to the spring. The swingable part can be swung into two positions in which in each case it holds one connection (24, 28) in communication with the chamber, and in the position of the rest, it keeps neither of the two connections in communication with the chamber. With respect to its construction, the displacement device of the invention is in this case, to be sure, more expensive but, on the other hand, the danger of the dirtying of the valves in this construction is very slight due to their always open position; and the displacement devices are more resistant to vibration since moving parts can be balanced.

BRIEF DESCRIPTION OF THE DRAWINGS

With the above and other objects and advantages in view, the present invention will become more clearly understood in connection with the detailed descriptions of preferred embodiments, when considered with the accompanying drawings, of which.

DETAILED DESCRIPTION OF THE PREFERRED EMBODIMENT

Figure 1:
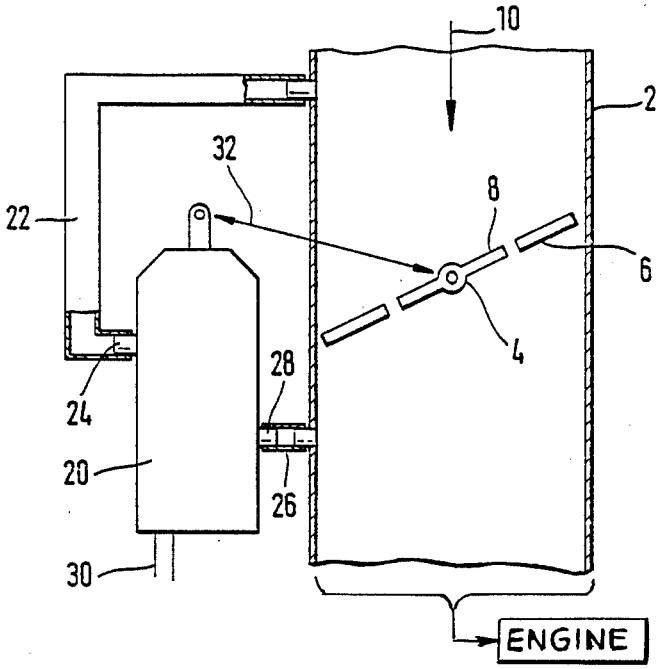
FIG. 1 shows the general arrangement of a displacement device for a throttle valve of an internal combustion engine.

Reference is first had first of all to FIG. 1, which shows the construction of a displacement device in a general manner. A throttle valve 4, which is divided in the embodiment shown, is arranged in an intake pipe 2 of an internal combustion engine, the throttle valve comprising a larger throttle valve part 6 and a smaller control valve 8. The direction of flow of the intake air is indicated by an arrow 10.

A displacement device 20 for the throttle valve 4 has a connection 24 for atmospheric pressure, connected via a line 22 to the intake pipe 2 upstream of the throttle valve, a connection 28 for vacuum, connected via a line 26 to the intake pipe 2 downstream of the throttle valve, and an electric connection 30. A double arrow 32 between the displacement device 20 and the throttle valve 4 represents the correcting members and further connecting parts between said devices.

Figure 2:
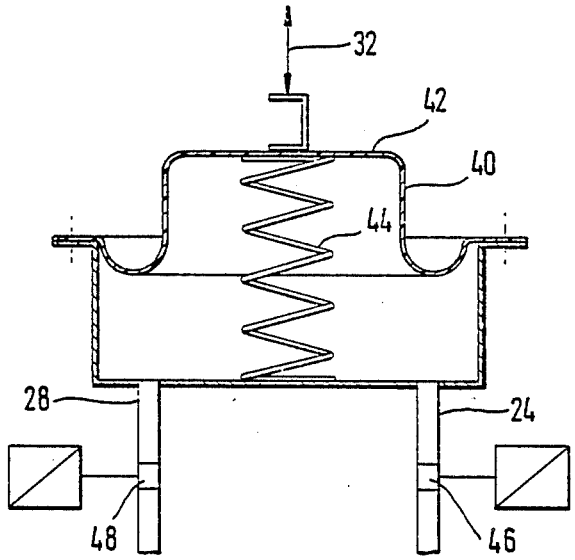
FIG. 2 is a view of the construction of a displacement device in accordance with the state of the art.

FIG. 2 shows the construction of a displacement device 20 in accordance with the state of the art. A moveable diaphragm 42, for instance a roller diaphragm, is located at one end, on top in FIG. 2, in a housing 40, said diaphragm being connected on the outside to the throttle valve 4 (FIG. 1) via connecting parts and correcting members of conventional form. From the inside, the diaphragm 42 is urged into a basic position by a spring (44). The inside of the housing 40 is connected via the two connections 24, 28 to a source of atmospheric pressure and a source of vacuum. The connections 24, 28 can be opened or closed by means of two electrically actuated valves 46, 48. When acted on by atmospheric pressure the diaphragm 42 is displaced upward and when acted on by vacuum the diaphragm returns into its lower basic position. It may happen, as a result of frictional phenomena, that despite the application of a setting signal no displacement of the control valve takes place and the desired quantity of air can therefore not be fed through the throttle valve.

Figure 3:
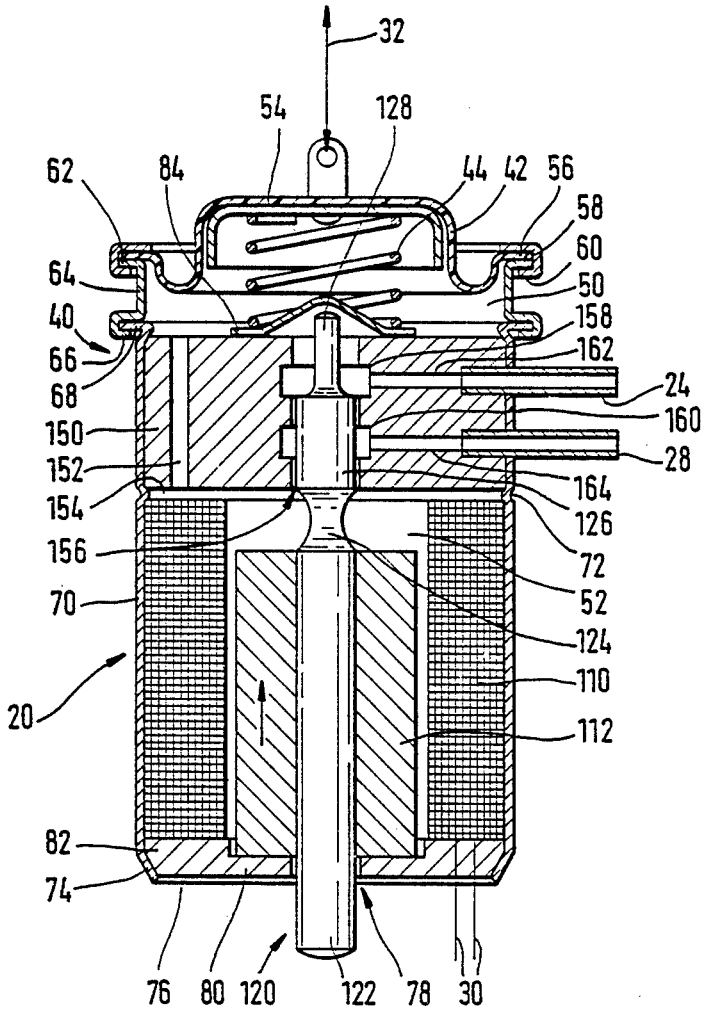
FIG. 3 is an axial sectional view of the construction of a first embodiment of a displacement device in accordance with the invention, in which a control section of the valve body is in a first-control position.
Figure 4A:
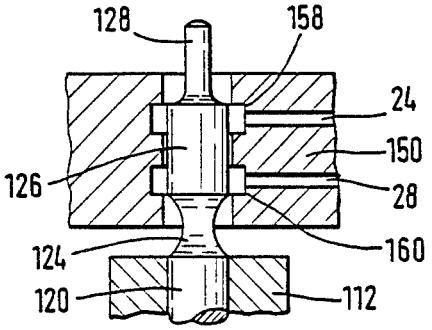
FIGS. 4*a* and 4*b* are partial sectional views of the displacement device of FIG. 3, which show the valve body in a second and third control position.
Figure 4B:
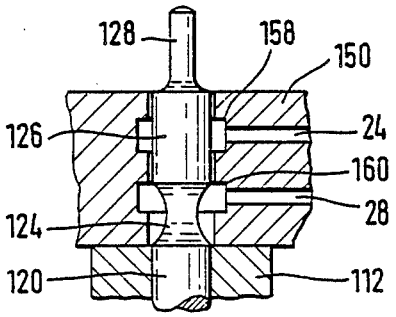

FIG. 3 shows the construction of a displacement device 20 in accordance with the invention. To the extent that the parts are the same as those of the known displacement device shown in FIG. 2, they have been provided with the same reference numbers. The hermetically developed housing 40 comprises two chambers 50, 52. In one chamber 50 there are located the diaphragm 42, which is developed as roller diaphragm, and the spring 44, the connections 24 and 28 also debouching there. In the other chamber 52 there are provided correcting means and a damping device for the valve body 210 which will be explained in greater detail below.

A flexible cup-shaped cover 54 having a flange section 56 is mounted at one end (the upper end in FIG. 3) of the housing 40 in a first annular section 58 with a flange section 60, said annular section forming a receiving groove. The flange section 56 of the cover 54 rests in this case on an upper flange section 62 of a cylindrical second annular section 64 which has a lower flange section 66 bent downward and inward. In the receiving space formed by the annular section 64 and the flange section 66 there is seated a flange section 68 of a cylindrical section 70 which extends to the bottom of the housing 40 and has small indentations 72 and 74 in axial direction somewhat above the middle and at the lower end respectively. The lower indentation 74 forms a holding edge on which a bottom part 76 rests. The bottom part 76 is developed as a plate having an axial passage opening 78 and, adjacent to the passage opening, an annular section 80 of smaller thickness and an outer annular section 82.

Between the flange section 66 and the upper indentation 72 there is a separator part 150 which separates the upper chamber 50 from the lower chamber 52. An annular coil 110 is arranged on the outer annular section 82 of the bottom part 76, said coil extending up to the upper indentation 72 and being held between it and said outer annular section 82. The coil 110 is connected to the electrical connection 30. An inner edge section of the outer annular section 82 is left free by the coil 110.

The separator part 150 is arranged at a slight axial distance from the top of the coil 110 and has a passage 152 which connects the upper chamber 50 with the lower chamber 52 via a gap 154 formed in this way. A central passage 156 in the separator part also connects the two chambers 50, 52 to each other. The central passage 156 has two annular grooves 158, 160 spaced axially from each other and from the top and bottom sides, each of the annular grooves being connected via a radial line 162, 164 to connections 24, 26 for atmospheric pressure and vacuum, respectively. An upwardly arched plate part 84, on which the lower end of the spring 44 is supported, is seated on the top side of the separator part.

A cylindrical valve body 120, developed as slide, extends through the passage opening 78 of the bottom part 80 and through the central passage 156 of the separator part 150 and can be brought into engagement with the plate part 84. The valve body 120 is subdivided axially into four sections of different diameters and functions.

A lower armature section 122 is surrounded by a hollow cylindrical armature 112 rigidly attached to it, its lower end remaining free. The armature section 112 has such a diameter that it extends substantially up to the outer edge of an annular section 80, a gap thus being present between it and the coil 110. The length of the armature section 112 is shorter than that of the coil 110.

The armature section 122 of the valve body 120 is followed by a short, second control section 124 of smaller diameter which can be undercut or bent but which may also have some other shape.

The second control section 124 is followed by a first control section 126 the diameter of which is somewhat smaller than the inside diameter of the surrounding wall section, i.e. of the central passage 156 of the separator part 150. In the embodiment shown, the diameter of the first control section 126 is the same as that of the armature section 122. The first control section 126 is longer than the second control section 124 and shorter than the central passage 156. The length of the first control section 126 is sufficient so that it can simultaneously substantially close off both annular grooves 158 and 160. The first control section 126 is followed by the third control section 128 which, in the upper lift position of the valve body 120, strikes with its upper end against the plate part 84. The diameter of the third control section 128 is smaller than that of the first control section 126 and, in the embodiment shown, smaller than that of the second control section 124. In the embodiment shown, the length of the third control section 128 is somewhat larger than that of the first control section 124.

FIG. 3 shows the valve body 120 in the currentless or downward-controlled lower position in which the armature section 112 rests on the annular section 80 and the first control section 126 closes the lower annular groove 160 and the connection 28 for the vacuum. The third control section 128 is opposite the upper annular groove 158, so that the connection 24 for atmospheric pressure is in communication with the upper chamber 50.

FIG. **4*a* shows the valve body 120 in its middle position, in which the first control section 126 closes off both annular grooves 158, 160 and the connections 24, 28**, respectively. This is also the middle position of the control current.

FIG. **4*b* shows the valve body 120 in the upward-controlled, upper position with maximum control current, in which the first control section closes off the upper annular groove 158 and the connection 24** for atmospheric pressure, respectively.

The second control section 122 is opposite the lower annular groove 160, so that the connection 28 for vacuum is in communication with the upper chamber 50.

The displacement device or control in accordance with the invention operates as follows: In the position of FIG. 3, the upper chamber 50 is in communication with the connection 24 for atmospheric pressure. Due to the relatively higher pressure, the diaphragm 42 is displaced upward under the influence of the force of the spring 44, the latter being in this way relaxed. Upon actuation by a given current, the valve body 120 is then also displaced upward into the upper position according to FIG. **4*b*, in which the connection 24 for atmospheric pressure is closed and the connection 28 for vacuum is opened. A vacuum is then present in the lower chamber 52. An equalization of pressure with the chamber 50 takes place, on the one hand, via the central passage 156 and, on the other hand, via the gap 154 and the passage 152. This leads to a pressure drop in the chamber 50**, as a result of which the diaphragm is again displaced downward and the spring is more strongly acted on by pressure. The valve body can assume the middle position.

The action of the control current in this case will now be explained. Proceeding from this position, a strong control current has the result that the valve body 120 is lifted into the upper position. As a result of the strong vacuum, the diaphragm 42 is then applied against the lower stop. If the coil is then acted on only by medium control current, the valve body will assume approximately the middle position, i.e. a position of equilibrium corresponding to the force of the spring 44 acting on it in downward direction and to the force acting in upward direction due to the control current via the armature 122.

With the valve body in this position, if the control current is somewhat increased, then the valve body 120 moves upward, the pressure in the chamber 50 decreases further and the diaphragm 42 moves downward, it displacing the valve body 120 again into the middle position. With the valve body in this position, if the control current is somewhat reduced, then the spring 44 pushes the valve body 120 downward into the lower position in which the pressure in the chamber 50 is increased, whereby the diaphragm 42 is moved upward, the spring 44 is relaxed and the valve body 120 is again displaced back into the middle position. A mechanical feedback takes place.

For this middle position there accordingly exists a given control current which is required to maintain it. The precise position of the former may change in the course of time and thus also the required specific control current. Reduced mobility of mechanical parts may also have the result that the time required to set this middle position becomes longer due to the increased inertia of the system. However, assurance is always had that the valve body 150 assumes a position in which a change in the control current, i.e. the control current proper, results in a displacement of not only the valve body but also of the diaphragm 42. With the application of such control, the displacement of the control valve 8 can be carried out very accurately.

Figure 5:
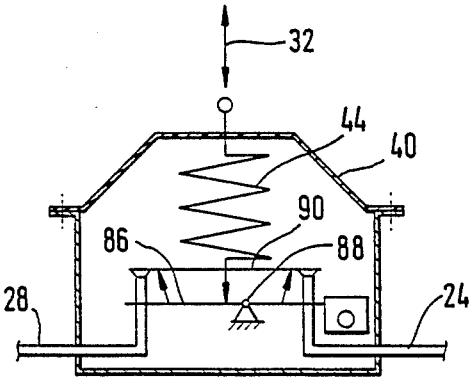
FIG. 5 is a view of the construction of a second embodiment of a displacement device in accordance with the invention, in a first control position.

FIG. 5 is a partial view of a second embodiment of the displacement device in accordance with the invention. To the extent that the parts thereof are the same as in the embodiment described above, they have been given the same reference numbers and will not be described again. The spring abutment is a swingable plate 86 the axis of swing 88 of which is arranged axially displaced. Another plate 90 is arranged axially above the swingable plate 86 and is connected, on the one hand, to the swingable plate 86 as a function of the position of which it changes its own position, and is operatively connected to the two connections 24, 28 the opened and closed positions of which are thus determined by the corresponding instantaneous spring/swing plate force relationships and the pressure. The structure of this variant of the displacement device is very vibrationresistant. The structural and functional features are otherwise the same as in the case of the first embodiment.

I claim:

1. A system including an electropneumatic displacement device connected to a throttle valve of an internal combustion engine in idling condition, the displacement device comprising a housing having a chamber;

a diaphragm disposed in the chamber in the housing, the diaphragm forming an outer wall of the chamber and of the housing and being operatively connected to the throttle valve;

a spring in the chamber, the spring having a first end and a second end opposite the first end, the first spring end acting against the diaphragm;

a connection on the housing for atmospheric pressure, a magnet coil in the housing;

an armature which is axially displaceable in the magnet coil in response to electric current in the coil; and a valve body firmly attached to the armature, the valve body holding said connection for atmospheric pressure open or closed corresponding to a position of the valve body; and wherein the displacement device further comprises a connection on the housing for vacuum;

said connections for vacuum and atmospheric pressure are alternately kept open by the valve body;

the valve body is acted on by the second end of the spring; and the coil current in the magnet coil serves as a control variable for positioning the throttle valve.

2. A system according to claim 1, wherein the throttle valve is provided with an intake port downstream of the throttle valve and an intake port upstream of the throttle valve; and the connection for vacuum is connected to the intake port downstream of the throttle valve, and the connection for atmospheric pressure is connected, to the intake port upstream of the throttle valve.

3. A system according to claim 1, wherein the throttle valve comprises a smaller control valve.

4. A system according to claim 1, wherein the diaphragm is a roller diaphragm.

5. A system according to claim 1, wherein, the displacement device further comprises has an air-chamber damping device coupled to said chamber.

6. A system according to claim 1, wherein the valve body comprises a piston slide, there being a wall section surrounding the piston slide; and annular grooves, are provided in a connection region in the wall section, the connection region comprising said connections for vacuum and atmospheric pressure, said connections being arranged axially spaced from each other along an axis of the piston slide.

7. A system according to claim 6, wherein said cylindrical control section has a diameter which is somewhat smaller than the inside diameter of the wall section surrounding the valve body;

adjacent to the first control section, there is a further control section of smaller diameter; and wherein a positioning of the first control section with respect to a connection determines its closed condition, and a positioning of the further control section with respect to a connection determines its open condition, an axial dimensioning of the first control section provides that the valve body can be positioned simultaneously with respect to both of said connections.

8. A system according to claim 6, wherein the connection for atmospheric pressure is disposed closer to said chamber that the connection for vacuum.

9. A system according to claim 1, wherein the displacement device further comprises a plate shaped part; and wherein the spring is supported on the plate-shaped part, the valve body being in engagement with the plate-shaped part.

10. A system including an displacement device connected to a throttle valve of an internal combustion engine in idling condition, the displacement device comprising a displacement device for a throttle valve of an internal combustion engine in idling condition, having a housing, a diaphragm arranged in a chamber in the housing, the diaphragm being operatively connected to the throttle valve, a spring in the chamber which acts with its one end against the diaphragm, a connection for vacuum to the chamber, a connection for atmospheric pressure an axial adjustable setting part, the valve body holding a connection for atmospheric pressure open or closed, corresponding to its position at the time, alternately kept open by the valve body;

the valve body is acted on by the second end of the spring; and the coil current in the magnet coil serves as a control variable for positioning the throttle valve wherein the spring is supported for instance, preferably on a swingable part the axis of swing of which is axially staggered with respect to the spring; and the swingable part can be swung into two positions in which in each case it holds one connection in communication with the chamber, and in the position of the rest, it keeps neither of the two connections in communication with the chamber.

* * * * *